United States Patent [19]

Cochran et al.

[11] 3,977,867

[45] Aug. 31, 1976

[54] GRAY IRON CASTING COMPOSITION WITH CONTROLLED IRON-CHROMIUM CARBIDE CONTENT

[75] Inventors: Steven C. Cochran, Peoria; Lawrence W. McFarland; Baltasar R. Weiss, both of Pekin, all of Ill.

[73] Assignee: Caterpillar Tractor Co., Peoria, Ill.

[22] Filed: July 14, 1975

[21] Appl. No.: 595,935

Related U.S. Application Data

[63] Continuation of Ser. No. 402,277, Oct. 1, 1973, abandoned.

[52] U.S. Cl. ..... 75/126 A; 75/123 CB; 75/126 Q; 148/35

[51] Int. Cl.[2] ..... C22C 37/06; C22C 37/10

[58] Field of Search ..... 75/126 A, 126 Q, 123 CB; 148/35

[56] References Cited

UNITED STATES PATENTS

| | | | |
|---|---|---|---|
| 1,898,390 | 1/1932 | Pfeil | 148/35 |
| 1,910,034 | 5/1933 | Mitchell | 75/126 A |
| 1,984,474 | 12/1934 | Good | 148/35 |
| 2,145,757 | 1/1939 | Ervin | 75/123 CB |
| 2,579,452 | 12/1951 | Eckman et al. | 75/123 CB |
| 2,684,900 | 7/1954 | Webbere | 75/123 CB |
| 3,273,998 | 9/1966 | Knoth | 148/35 |

FOREIGN PATENTS OR APPLICATIONS

| | | | |
|---|---|---|---|
| 85,654 | 5/1971 | Germany | 75/126 A |

*Primary Examiner*—Arthur J. Steiner
*Attorney, Agent, or Firm*—Charles E. Lanchantin, Jr.

[57] ABSTRACT

A gray iron casting particularly suitable for automotive camshafts or the like includes, by weight, 3.10 to 3.45 percent carbon, 1.60 to 1.70 percent silicon, 0.60 to 0.80 percent chromium, 0.40 to 0.90 percent manganese, and the balance iron with residual impurities individually limited to less than 0.40 percent to provide a relatively high, yet closely controlled iron-chromium carbide content of from 20 to 40 percent in a preselected region thereof for improved resistance to wear, with the remainder being relatively more pearlitic and graphitic for increased strength.

4 Claims, 4 Drawing Figures

100X

500X

GRAY IRON CASTING COMPOSITION WITH CONTROLLED IRON-CHROMIUM CARBIDE CONTENT

This is a continuation of Ser. No. 402,277, filed 10-1-73, now abandoned.

BACKGROUND OF THE INVENTION

Gray irons suitable for automotive castings in general, and hardenable alloy gray irons used in making heavy duty automotive camshafts in particular, have heretofore been produced by melting a charge of iron and steel materials in a cupola. During such processing, it has been found necessary to add costly alloys, in closely controlled amounts, to the cupola to produce a machinable casting having the desirable wear and strength properties.

Two known chemical compositions for hardenable alloy gray irons in percent by weight are set forth below:

| | Gray Iron A | Gray Iron B |
|---|---|---|
| Total Carbon | 3.10 – 3.45 | 3.10 – 3.40 |
| Silicon | 2.10 – 2.40 | 1.70 – 2.00 |
| Chromium | 0.85 – 1.20 | 0.40 – 0.60 |
| Manganese | 0.60 – 0.90 | 0.55 – 0.85 |
| Molybdenum | 0.40 – 0.60 | 0.42 – 0.58 |
| Nickel | 0.20 – 0.45 | 1.00 Min. |
| Phosphorus | Trace – 0.20 | Unknown |
| Sulphur | Trace – 0.20 | Unknown |
| Iron | Remainder | Remainder |

Unfortunately, even though the chemical composition of the cupola charge is closely controlled to provide the above-mentioned percentages, the castings which are produced continue to vary greatly in the characteristics of the microstructure and particularly do not meet the relatively high controlled carbide content desired. In some cases the chromium and molybdenum percentage levels have been balanced by costly nickel additions to produce the required mechanical properties of the casting such as high tensile strength, with the promotion of relatively significant percentages of controlled carbides along with the accompanying increased wear resistance not being a factor. In other cases the castings which have been produced have frequently had a secondary carbide or controlled carbide content below the desired percentage range, e.g., 20 percent to 40 percent, with the result that such castings have been scrapped because they were too soft and would experience a high rate of wear. Such higher rates of scrap, and the use of expensive alloy additions in an attempt to obtain the relatively high controlled carbide content, have raised the cost of these castings and this has forced the industry to accept castings of poorer quality than that desired.

SUMMARY AND OBJECTS OF THE INVENTION

It is therefore an object of the present invention to provide a high quality gray iron casting with a minimum of costly alloy addition particularly well suited for automotive use which has a relatively high, yet closely controlled carbide content for increased resistance to wear.

Another object of the invention is to provide a method of casting such a gray iron so that a controlled carbide content of from 20 percent to 40 percent can be obtained in a preselected region of the casting for high wear resistance, with the remainder being more pearlitic and graphite for strength.

Another object of the invention is to provide a gray iron camshaft having the above-mentioned properties, and wherein the preselected region having such relatively high controlled carbide content is in the cam lobe portion of the camshaft.

Other objects and advantages of the present invention will become more readily apparent upon reference to the accompanying drawings and the following description.

DESCRIPTION OF PREFERRED EMBODIMENT

Figure 2:
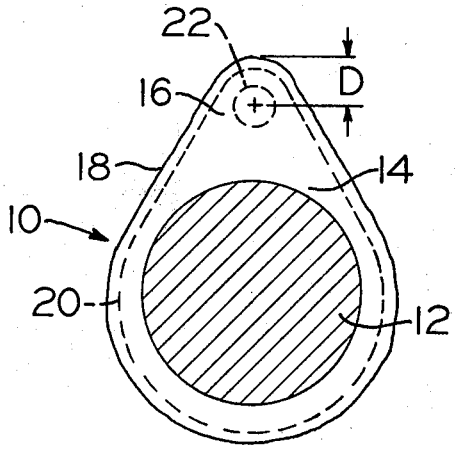
FIG. 2 is a transverse sectional view of a cast camshaft having the gray iron composition of the present invention and showing a cam lobe portion and a body portion with distinctly different wear and strength requirements.

Referring to FIG. 2, a typical cross section of a gray iron camshaft indicated generally by the reference numeral 10 and embodying the gray iron composition of the present invention includes a cylindrical body portion 12 and a generally encircling cam portion 14 which require distinctly different microstructures. While it is desirable that the body portion be relatively strong, the cam portions of such a camshaft should exhibit higher hardness for increased resistance to wear.

Figure 3:
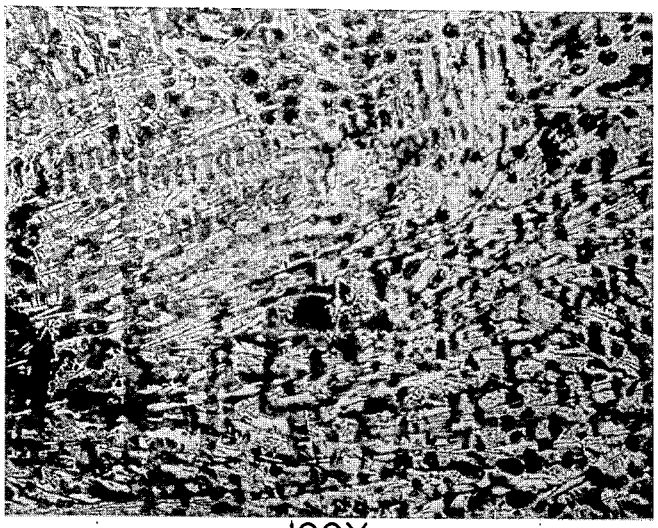
FIG. 3 is a photomicrograph of a portion of a polished and etched section of a cast camshaft embodying the gray iron composition of the present invention at a magnification of approximately 100 times showing the desired metallurgical structure of a preselected region thereof.
Figure 4:
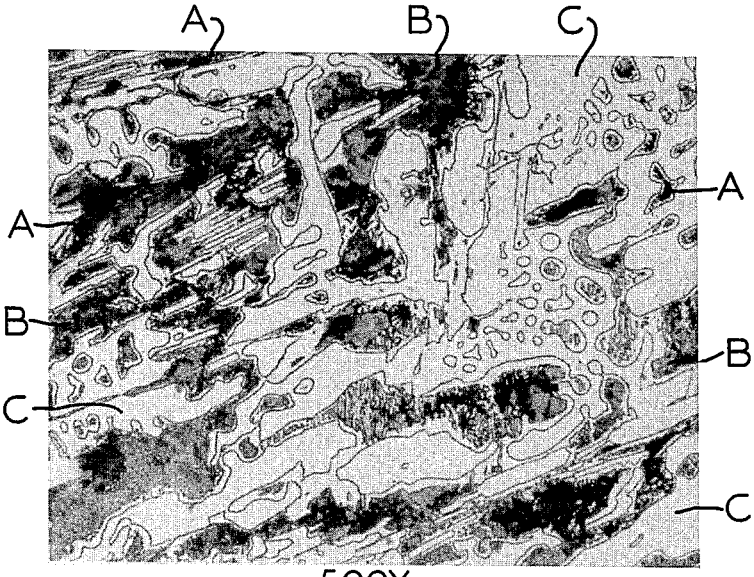
FIG. 4 is a photomicrograph of a polished and etched section of a cast camshaft similar to FIG. 3 only taken at an increased magnification level corresponding to approximately 500 times showing in greater detail the desired metallurgical structure which is obtained with the gray iron composition of the present invention.

More particularly, each cam portion 14 of the camshaft 10 is cast with one or more cam lobes 16 thereon. This results in the formation of a rough peripheral face 18 on the cam portion that is subsequently machined to provide a reduced and specific cam profile 20. It has been found desirable to establish a relatively high and closely controlled iron-chromium carbide content in a preselected region 22 of each of these cam lobes. Such controlled carbide content is in the range of from 20 percent to 40 percent, and preferably approximately 30 percent, with 5 percent deviation. Photomicrographs, such as shown in FIGS. 3 and 4 and discussed further below, are taken at a preselected distance D from the peripheral face 18 to provide the evidence that the gray iron microstructure of the camshaft at the preselected region 22 meets this controlled carbide content.

To arrive at the aforementioned controlled iron-chromium carbide content, the gray iron casting composition of the present invention has been found extremely effective and economical. Such gray iron composition includes in percent by weight:

| | Gray Iron With Controlled Carbide Content |
|---|---|
| Total Carbon | 3.10 – 3.45 |
| Silicon | 1.60 – 1.70 |
| Chromium | 0.60 – 0.80 |
| Manganese | 0.40 – 0.90 |
| Molybdenum | Trace – 0.40 |
| Nickel | Trace – 0.20 |
| Phosphorus | Trace – 0.20 |
| Sulphur | Trace – 0.20 |
| Iron | Remainder |

It is noted that the relatively low percentage levels of molybdenum, nickel, phosphorus, and sulphur in the gray iron composition of the present invention qualify these elements as residual impurities. The manganese level is also established within a relatively broad range and could be considered a residual impurity from the standpoint that it usually remains within the imposed percentage limits even though the proportion of different ingredients utilized in the furnace charge such as scrap, pig iron and steel varies considerably.

Figure 1:
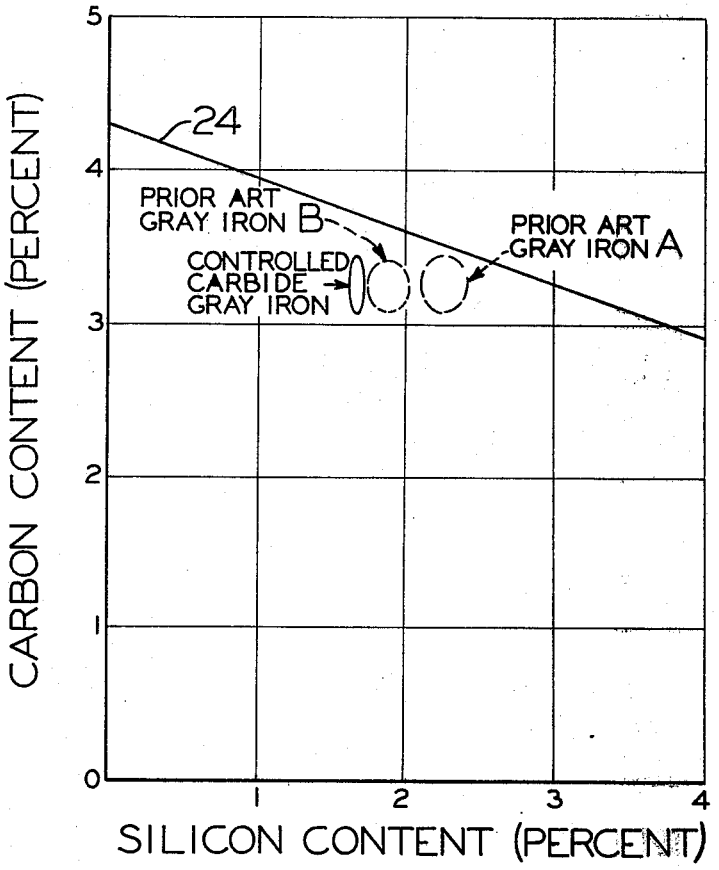
FIG. 1 is a graph showing the relationship of carbon content in percent by weight and silicon content in percent by weight in the gray iron composition of the present invention, and with respect to the chemical composition of two known prior art gray irons.

From the 1.60 to 1.70 percent silicon and 0.60 to 0.80 percent chromium levels set forth above, it should be recognized that the gray iron composition of the present invention could be referred to as a low silicon, low alloy gray iron. The low silicon aspect thereof is best shown in the graph of FIG. 1 in comparison with prior art gray irons A and B, the full chemical compositions of which were set forth above. Such graph presents the percentage of carbon to the percentage of silicon in the gray iron, which is related to the capacity of the composition to produce graphite. This relationship is often referred to as the carbon equivalent factor (C.E.) and is calculated as follows:

C.E. = Percent total carbon + ⅓ percent silicon

The C.E. of a cast iron describes how close a given analysis is to that of the eutectic composition. When the C.E. is 4.3, represented by the line 24 on the graph, the alloy is a eutectic. On the other hand, the gray iron composition of the present invention is approximately 3.85, which is an alloy of lower carbon and silicon content than the eutectic composition, and is thereby hypoeutectic. Such a C.E. value establishes the approximate melting temperature of the alloy as well as being a measure of other properties such as strength. From FIG. 1 it can be appreciated that the gray iron composition of the present invention utilizes a closely controlled and relatively low percentage of silicon which generally increases the solubility of carbon in the iron. Thus, the influence that the silicon will have as a relatively powerful graphitizer of iron carbides is limited thereby.

The camshaft 10 is made from generally available ingredients including a charge of selected gray iron and steel materials of varying analysis to provide a molten iron having a generally high base chill characteristic. This is achieved through selection and matching of the various elements. For example, manganese, which is a carbide stabilizer, is established at 0.40 to 0.90 percent by weight. It combines with the normally low amount of sulphur in the iron to form manganese sulfide, which then occurs as randomly distributed particles of extremely small size in the microstructure and not normally observable at the usual levels of photographic magnification. As manganese sulfide, the effect of sulphur in promoting a pearlitic structure is reduced.

On the other hand, the desired 0.60 to 0.80 percent chromium in the charge is usually low, and since chromium is generally considered to be a chill inducing element and a carbide stabilizer, it has been found desirable to add chromium in the form of ferrochrome to the charge in order to obtain the desired percentage. The relatively low chromium level along with the relatively low silicon level promotes the desired iron-chromium carbide formation for increased wear resistance.

With the above controlled levels of carbon, silicon, chromium, and manganese, it is significant to note that the percentages of molybdenum and nickel are maintained at generally lower levels than prior art gray irons. Although molybdenum is considered a carbide stabilizer and thus would be helpful in maintaining a relatively significant controlled carbide content, nickel is a graphitizer and would not be beneficial, and further would tend to neutralize the effect of the chromium. Thus, the gray iron composition of the present invention does not require the addition of costly alloys such as nickel to the charge. The balance of the residual impurities, mainly phosphorus and sulphur, are individually limited to levels below 0.20 percent. Accordingly, molybdenum, nickel, phosphorus, and sulphur need not be considered as normal additions to the varying composition of the furnace charge of the present invention since only very low percentage levels of these elements are desired.

The photomicrographs of FIGS. 3 and 4 show the desired physical properties of the gray iron camshaft 10 of the present invention obtained in the area of the preselected region 22 shown in FIG. 2. These polished and etched views of the metallurgical structure to levels of magnification corresponding to 100 and 500 times show a controlled iron-chromium carbide content of approximately 30 percent in a pearlitic matrix which is obtained with the aforementioned composition of elements. The small black areas, identified at A in FIG. 4, are free graphite. The dark gray areas in the photomicrograph, shown by the letter B, are pearlite or of generally ferritic and cementitic composition. And, the light areas identified by the letter C are iron-chromium carbide and relatively hard areas of the structure. This relatively high controlled carbide content greatly enhances the wear resistance of the casting.

OPERATION

While the gray iron composition, microstructure, and operation of the present invention are believed clearly apparent from the foregoing description, further amplification will subsequently be made in the following brief summary of such operation. In the processing of the gray cast iron of the present invention it is significant to note use of an induction furnace as opposed to a cupola furnace for melting the charge. With an induction furnace the charge can be approximately half gray iron returns and half steel scrap to result in a charge having a relatively high base chill. This will normally dictate addition of carbon preferably in the form of calcined petroleum coke, silicon preferably as ferrosilicon, and chrome preferably as ferrochrome to generally reach the desired gray iron chemical composition set forth above as established by standard spectrochemical analysis. However, the silicon level is initially maintained at a relatively low level during the furnace heating phase in order to assure that the controlled carbide content will be slightly on the high side of the desired final controlled carbide content percentage.

A standard test base chill sample is taken of the furnace charge which is heated to a temperature of approximately 2800° F. utilizing a relatively high power density furnace for thorough mixing. The base chill test is commonly used by foundrymen to determine the relative sensitivity of the iron to form iron carbide or graphite during solidification and takes into account the effect of the cooling rate of the metal. Since castings often have varying thicknesses and thus different cooling rates, the metal often solidifies in dissimilar ways and the beneficial aspects of this variable rate of cooling are particularly adaptable to the subject camshaft casting which is made by pouring the liquid metal into a sand mold containing a cavity corresponding to the desired camshaft pattern. Since the cam lobes 16 of the camshaft 10 of the present invention project from the larger body portion 12, they cool more quickly during the solidification phase. This beneficially contributes to the formation of the desired final relatively high controlled iron-chromium carbide content in the preselected region 22 thereof which is correlated to the base chill test results. As determined by such test results of a melt purposely providing a slightly higher than desired final controlled carbide content, additional silicon is added as an inoculating agent. This reduces the base chill of the charge and provides additional nuclei for pearlite and graphite formation during solidification and thus establishes within relatively close limits the desired final controlled carbide content. Such inoculating agent is added at the time of pouring the melt into the mold for increased potency which is done at approximately 2500° F. Preferably the inoculating agent is ferrosilicon and is added in increments of approximately 0.1 percent adjacent the pouring spout of the induction furnace during pouring to easily and consistently control the graphitizing rate of the gray cast iron of the present invention.

This procedure has proven extremely effective in obtaining repeatably accurately controlled iron-chromium carbide contents above 20 percent in the preselected region 22 of the gray iron camshaft 10. As a result, the camshafts made with the aforementioned procedure and by balancing the graphitizing characteristics of the silicon, chromium, and manganese levels have exhibited increased resistance to wear in the area of the cam lobe 16, while maintaining an appreciably more pearlite and graphitic microstructure in the area of the body portion 12 for increased strength. The superior gray iron casting of the present invention is also economical to produce because the costly alloy additions so typical with prior art compositions have been avoided.

While the invention has been described and shown with particular reference to the preferred embodiment, it will be apparent that variations might be possible that would fall without the scope of the present invention, which is not intended to be limited except as defined in the following claims.

What is claimed is:

1. A gray iron casting consisting essentially of, in percentage by weight, 3.10 to 3.45 percent carbon, 1.60 to 1.70 percent silicon, 0.60 to 0.80 percent chromium, 0.40 to 0.90 percent manganese, and the balance iron with residual impurities including less than 0.40 percent molybdenum and other residual impurities individually limited to less than 0.20 percent; said gray iron casting having a closely controlled iron-chromium carbide content of from 20 to 40 percent in a preselected region thereof for improved resistance to wear, and with the remainder of said casting being more pearlitic and graphitic than said preselected region.

2. A gray iron camshaft for an internal combustion engine cast of an alloy consisting essentially of, in percentage by weight, 3.10 to 3.45 percent carbon, 1.60 to 1.70 percent silicon, 0.60 to 0.80 percent chromium, 0.40 to 0.90 percent manganese, and the balance iron with residual impurities including less than 0.40 percent molybdenum and other residual impurities individually limited to less than 0.20 percent; said camshaft having a closely controlled iron-chromium carbide content of from 20 to 40 percent in a preselected region thereof for improved resistance to wear.

3. The gray iron camshaft of claim 2 having a cross section defining a body portion and a cam lobe portion, and wherein said preselected region is established in said cam lobe portion.

4. The gray iron camshaft of claim 3 wherein said controlled iron-chromium carbide content is preferably 30 percent, with 5 percent deviation.

* * * * *